US006520457B1

(12) United States Patent
Yardley et al.

(10) Patent No.: US 6,520,457 B1
(45) Date of Patent: Feb. 18, 2003

(54) COLLAPSIBLE DEVICE FOR SUPPORTING A DISPOSABLE PLASTIC BAG

(75) Inventors: Melvin W. Yardley, Aurora, UT (US); Kevin S. Yardley, Mount Pleasant, UT (US); Michael A. Yardley, Mount Pleasant, UT (US)

(73) Assignee: Kevin Yardley, Mount Pleasant, UT (US)

( * ) Notice: Subject to any disclaimer, the term of this patent is extended or adjusted under 35 U.S.C. 154(b) by 0 days.

(21) Appl. No.: 10/040,549

(22) Filed: Jan. 7, 2002

Related U.S. Application Data

(63) Continuation-in-part of application No. 10/007,975, filed on Nov. 13, 2001.
(60) Provisional application No. 60/311,616, filed on Aug. 10, 2001.

(51) Int. Cl.[7] ..... B65B 67/04
(52) U.S. Cl. ..... 248/99; 248/97
(58) Field of Search ..... 248/97, 99, 95, 248/100, 101

(56) References Cited

U.S. PATENT DOCUMENTS

| | | | | | |
|---|---|---|---|---|---|
| 3,563,505 | A | * | 2/1971 | Langley | 211/84 |
| 3,627,242 | A | * | 12/1971 | Vandermast | 248/97 |
| 3,796,402 | A | * | 3/1974 | Trotta | 248/101 |
| 3,916,962 | A | * | 11/1975 | Stolt | 141/108 |
| 4,267,997 | A | * | 5/1981 | Meier | 220/491 |
| 4,413,800 | A | * | 11/1983 | Kelson | 248/99 |
| 4,575,895 | A | * | 3/1986 | Spellman | 15/327.1 |
| 4,759,518 | A | * | 7/1988 | Yardas | 24/462 |
| 4,783,031 | A | * | 11/1988 | Ebentheuer | 248/97 |
| 4,899,967 | A | * | 2/1990 | Johnson | 248/97 |
| 4,901,959 | A | * | 2/1990 | Stage | 220/4.24 |
| 5,570,862 | A | * | 11/1996 | Nugent | 248/97 |
| 6,199,802 | B1 | * | 3/2001 | Scheibe, Sr. | 248/101 |
| 6,325,341 | B1 | | 12/2001 | Brown | 248/99 |

OTHER PUBLICATIONS

Better Bag'er by Givens; http:/www.givensinc.com/Bagger/Lawn.htm; pp. 1–2.

* cited by examiner

*Primary Examiner*—Ramon O. Ramirez
*Assistant Examiner*—Kofi Schulterbrandt
(74) *Attorney, Agent, or Firm*—Madson & Metcalf

(57) ABSTRACT

A collapsible device for supporting a disposable plastic bag is provided. The device includes a hoop having at least one tab that extends from the hoop to engage and retain a plastic bag supported within the hoop. The tabs engage and retain the bag mouth by friction. The device may include one or more legs to support the hoop above the ground. The device may also include a second hoop slideably connected to the legs to add additional support. The second hoop may include a collar and the legs may include corresponding stops. When the collars are slid along the legs and rest on the stops a bend may be created in the legs which prevents the collars from sliding away from the stops.

20 Claims, 6 Drawing Sheets

COLLAPSIBLE DEVICE FOR SUPPORTING A DISPOSABLE PLASTIC BAG

RELATED APPLICATIONS

This application is a continuation-in-part and claims priority to U.S. patent application Ser. No. 10/007,975, filed Nov. 13, 2001, for "A Collapsible Device for Supporting a Disposable Plastic Bag," which in turn claims priority to U.S. Provisional Patent Application Serial No. 60/311,616, filed Aug. 10, 2001, for "Device for Supporting a Disposable Plastic Bag," both with inventors Melvin W. Yardley, Kevin S. Yardley, Michael A. Yardley, which are hereby incorporated by reference.

BACKGROUND

1. Field of the Invention

The present invention relates generally to the field of yard and garden devices. More specifically, the present invention relates to a collapsible device for supporting a disposable plastic bag.

2. Description of Related Background Art

Disposable plastic bags are used ubiquitously in various applications. Their durable, light-weight, and disposable features have contributed to their popularity. However, when used for temporary tasks such as collection of trash, grass clippings, leaves, or other material, a disposable plastic bag alone is impractical. Typically, the mouth of the plastic bag tends to close or cling shut.

This problem is pronounced when one person must hold the mouth of the bag open while attempting to insert clippings or the like. Windy conditions exacerbate the problem by blowing the mouth closed, especially when the bag is empty or nearly empty. If the mouth is held open, one may efficiently insert clippings and other material. Generally, such tasks require two people, or a very dexterous person. However, even a single talented person may be unable to fully hold the bag open and also insert clippings.

One solution is to use a sturdy support container for the bag, such as a trash can lined with the plastic bag. However, trash cans particularly those designed to hold large yard bags, are large, heavy, and cumbersome. Furthermore, once filled, typically the plastic bag must be lifted from the trash can for disposal.

Other solutions offer a framework to support the plastic bag. However, these devices are often complicated, heavy, and cumbersome. Often such devices must be stored in an assembled condition, thereby wasting valuable storage space. Furthermore, the devices tend to solve one or two problems but do not offer a complete solution.

Accordingly, what is needed is a device that overcomes the problems and disadvantages of the prior art. In particular, the device should support a plastic bag of various sizes such that a single user may easily add or remove material from the bag and easily change a bag supported by the device without lifting the filled bag. Furthermore, the device should be light-weight, sturdy, durable, simple and inexpensive. In addition, the device should require minimal, or no, assembly for use and be easily collapsed for storage. Furthermore, the device should include a retaining mechanism for holding the bag upright and open which is simple, durable, contains no moving parts, and effective for bags of different sizes. The present invention provides these advancements in a novel and useful way.

BRIEF DESCRIPTION OF THE DRAWINGS

Non-exhaustive embodiments of the invention are described with reference to the figures, in which.

DETAILED DESCRIPTION OF THE PREFERRED EMBODIMENTS

Figure 1:
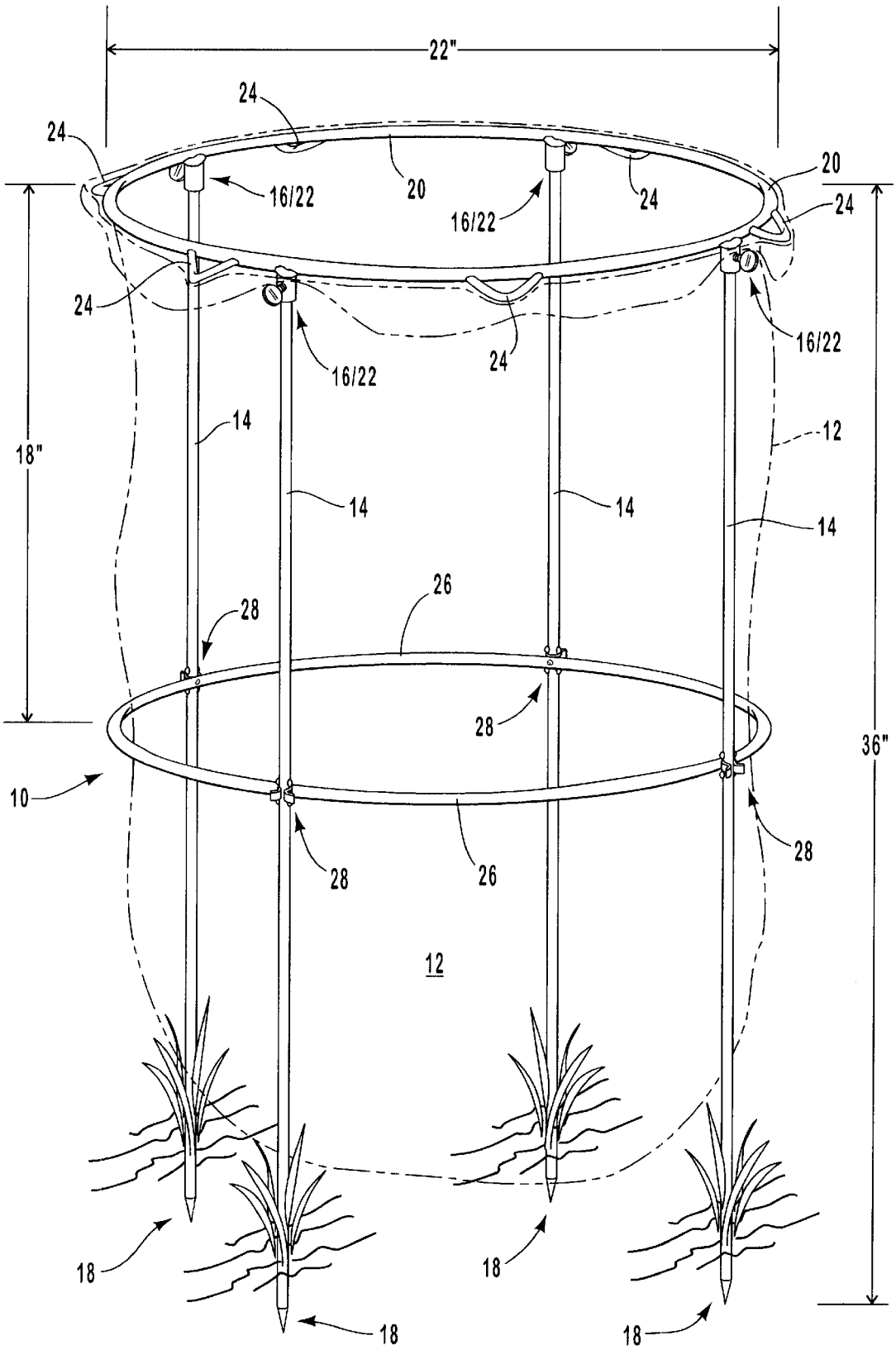
FIG. 1 is a side perspective view of one embodiment of the device supporting a plastic lawn bag.

The present invention solves the foregoing problems and disadvantages with a sturdy collapsible frame having a simple and durable retaining mechanism for the mouth of a plastic bag.

In one embodiment, the device includes a plurality of legs supporting a first hoop. The legs include a top end and a bottom end. Preferably, the legs are removably connected at the top end to the first hoop by one or more fasteners. In addition, the bottom ends may be configured to be easily pressed into the ground to support the device.

Preferably, the first hoop includes at least one tab that extends from the hoop. The tab may be rigidly attached to the hoop. The tab is configured to engage and retain a mouth of a plastic bag by friction. To secure the plastic bag, the bag is placed within the first hoop and the mouth of the bag is stretched and folded around the first hoop and the tab.

In a preferred embodiment, a plurality of tabs are evenly distributed about the perimeter of the first hoop. The plurality of tabs cooperate to effectively engage and retain the mouth of a plastic bag. In one configuration, the tabs extend from a plane defined by the hoop toward the legs at an angle between about zero and ninety degrees. Preferably, the tabs extend at an angle of about thirty degrees. Alternatively, the tabs may extend in any operable direction from the first hoop.

In certain embodiments, the device may include a second hoop. The second hoop may be removably connected to the plurality of legs between their top and bottom ends. The second hoop adds stability to the device. Preferably, the first and second hoops are removably connected to the legs by fasteners. Similar or different fasteners may be used to respectively connect the first hoop and the second hoop. Examples of possible fasteners include set screws, thumb screws, clip retainers, hook and loop assemblies, a socket, a threaded socket, reusable cotter pins, cotter pin and axle assemblies, detent notches, retaining hooks, spring biased detent nub and hole assemblies, and the like.

Preferably, the components of the device are made from durable, light-weight materials such as metal, metal alloys, hard plastic, wood, or the like. In one embodiment, the legs and hoops are made from rolled steel for high strength and minimal weight.

The components may be of various shapes while still serving their function. For example, the first and second hoops may be polygonal, circular, oval, or the like. Preferably, the legs are straight. Alternatively, the legs may be arcuate, zigzag, or the like. The tabs may be triangular. However, the tabs may also be square, rectangular, half-oval, half-circle, or the like.

The components may be sized to form a device capable of receiving and supporting a conventional plastic lawn bag. Of course, the device may also be manufactured to a size for supporting other size ranges of bags as well. Accordingly, the diameter of the first hoop is such that the mouth of the bag may be easily stretched and folded over the first hoop and attached tabs. Preferably, the legs are sized such that the bottom of an attached plastic bag rests on the ground. Alternatively, the legs may be longer to allow the bottom ends of the legs to be pressed into the ground for support. As the legs are pressed into the ground, the portion of the legs below ground level may be adjusted to optimally accommodate bags of different heights.

In an alternative embodiment, a hoop portion including one or more tabs may be coupled to a helical leg portion. The hoop portion and tabs may be configured as described above. The helical leg portion may be a helical spring configured to support the hoop portion when the helical leg portion is uncompressed.

Preferably, the helical leg portion is coupled to a base portion. To use this embodiment, the base portion rests upon the ground. The helical leg portion is uncompressed and supports the hoop portion at an operable height for engaging and retaining the plastic bag. The helical leg portion may be compressed in part to position the hoop portion at different heights. In addition, the helical leg portion may be compressed completely which positions the hoop portion in close proximity to the base portion. The compressed assembly may then be stored in a substantially thin space while not in use. The helical leg portion may be retained in a compressed state by ties, clasps, or like fasteners.

The base portion provides stability and support of the helical leg portion. The base portion may include one or more pins which extend from a side of the base portion opposite the side to which the helical leg portion is coupled. The pins may be pressed into the ground to provide additional support for the helical leg portion.

Preferably, the base portion, helical leg portion, and hoop portion may have substantially the same diameter and shape. Alternatively, one or all of the portions may be oval, circular, or polygonal shapes.

Thus, a durable, light-weight, collapsible device for supporting a plastic bag for temporary. tasks such as yard work is provided. The device may be easily assembled. In certain embodiments, no assembly is required. In addition, a single person may quickly secure a new plastic bag to the device by folding the mouth over the first hoop and tabs. A sole person may fill a plastic bag with debris without assistance and without fumbling to hold the bag open while inserting the debris.

While a plastic bag is referenced throughout this specification, those of skill in the art recognize that other kinds of bags may also be used with the present invention. For example, a burlap sack, a biodegradable paper bag, or reusable fabric bag may also be used with the present invention.

Reference throughout this specification to "one embodiment" or "an embodiment" means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment.

Furthermore, the described features, structures, or characteristics may be combined in any suitable manner in one or more embodiments. In the following description, numerous specific details are provided, such as examples of materials, fasteners, sizes, lengths, widths, shapes, etc., to provide a thorough understanding of embodiments of the invention. Similarly, while the figures may include dimensions, the dimensions are intended only for illustration and are not intended to limit the present invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

Referring now to FIG. 1, in one embodiment, there is shown a device 10 for supporting a disposable plastic bag 12. The device 10 serves as a light-weight framework for the plastic bag 12. As illustrated, the device 10 is self-supporting.

In the depicted embodiment, the device 10 includes four legs 14 to provide stability and support for the device 10. Each leg 14 may include a top end 16 and a bottom end 18. Preferably, the legs 14 are straight. In one embodiment, the legs 14 are about thirty-six inches in length. The bottom ends 18 of the legs 14 may be configured such that the legs 14 may be easily pressed into a lawn or the ground. For example, the bottom ends 18 may be sharpened to a point. Alternatively, the bottom ends 18 may be blunt.

The device 10 also includes a first hoop 20. The first hoop 20 provides a top support member for the bag 12. In certain embodiments, the first hoop 20 may be removably connected to the legs 14 by one or more fasteners 22. The fasteners 22 and legs 14 may be evenly distributed about the perimeter of the first hoop 20. Preferably, the fasteners 22 allow the legs 14 to easily be secured to and disassembled from the first hoop 20. For example, in one embodiment, the fasteners 22 comprise a thumb screw assembly 22.

Of course various fasteners 22 may be used to secure the legs 14 to the first hoop 20. For example, the top ends 16 may screw into threaded sockets formed in or connected to the first hoop 20. Alternatively, a removable cotter pin may secure the leg 14 between two arms. Furthermore, the leg 14 may include a spring biased detent nub which engages a hole formed in a socket attached to the first hoop 20. Additionally, those of skill in the art recognize a number of different removable fasteners 22 which may be used to temporarily secure the legs 14 to the first hoop 20.

The first hoop 20 also includes one or more tabs 24 which extend from the perimeter of the first hoop 20. The tabs 24 serve to extend the "effective" diameter of the first hoop 20. The tabs 24, discussed in detail below, function to engage and retain a bag 12 installed within the first hoop 20. Preferably, six tabs 24 are substantially evenly distributed about the perimeter of the hoop 20. For example, in one embodiment, a tab 24 may be positioned at each multiple of sixty degrees around the hoop 20. Of course, in alternative embodiments, any number of tabs 24 may also be evenly or un-evenly distributed about the hoop 20.

Preferably, the tabs 24 are rigidly connected to the first hoop 20. The tabs 24 may be connected by welding, gluing, rivets, as well as other techniques conventionally used by those of skill in the art.

In one embodiment, a second hoop 26 is removably connected to the legs 14 between the top and bottom ends 16, 18. Of course additional hoops 26 may be connected to the legs 14 to provide additional stability for the device 10. The second hoop 26 may be connected by a fastener 28 which allows the second hoop 26 to easily be connected and disconnected to the legs 14 without tools. In the depicted embodiment, clip retainers 28 are illustrated. Those of skill in the art recognize that various kinds of fasteners 28 may be used to connect and disconnect the second hoop 26 to the legs 14.

In one embodiment, the components of the device 10, such as the legs 14, are sized such that the first hoop 20 stands about thirty-four inches above the ground when the bottom ends 18 are pressed into the ground. In certain configurations, the second hoop 26 is positioned about eighteen inches below the first hoop 20. Preferably, the first hoop 20 is about twenty-two inches in diameter. In one embodiment, the second hoop 26 is substantially the same size as the first hoop 20. Alternatively, the second hoop 26 may be larger or smaller than the first hoop 20.

In the illustrated embodiment, a device 10 having dimensions as described above provides a sturdy frame work for supporting plastic bags 12 of 33, 39, or 42 gallons. Preferably, the bottom of the bag 12 rests on the ground while the device 10 supports the bag 12 and opens and retains the mouth. While specific sizes are illustrated, it is contemplated that components of the device 10 may have a wide range of operable sizes.

To provide a sturdy, light-weight, collapsible device 10 the present invention may be made of materials which are strong, light-weight and durable. For example, in a preferred embodiment, the legs 14 and hoops 20, 26 are made from ¼ inch hot or cold rolled steel rods. Alternatively, aluminum, wood, hard plastic, other metal alloys, and the like may be used.

Preferably, the legs 14 and hoops 20, 26 are made from cylindrical rods which are configured to serve as legs 14 and hoops 20, 26. The simplicity of the depicted embodiment allows for quick and inexpensive fabrication of the device 10. However, the legs 14 and hoops 20, 26 may, alternatively, be formed from materials having a square, rectangular, oval, or other cross-section. As mentioned above, the legs 14 are preferably straight. However, zigzag, or arcuate legs may be used. The hoops 20, 26 are preferably formed into a circular shape. Alternatively, the hoops 20, 26 may be in the shape of a polygon, oval, or the like.

Figure 2:
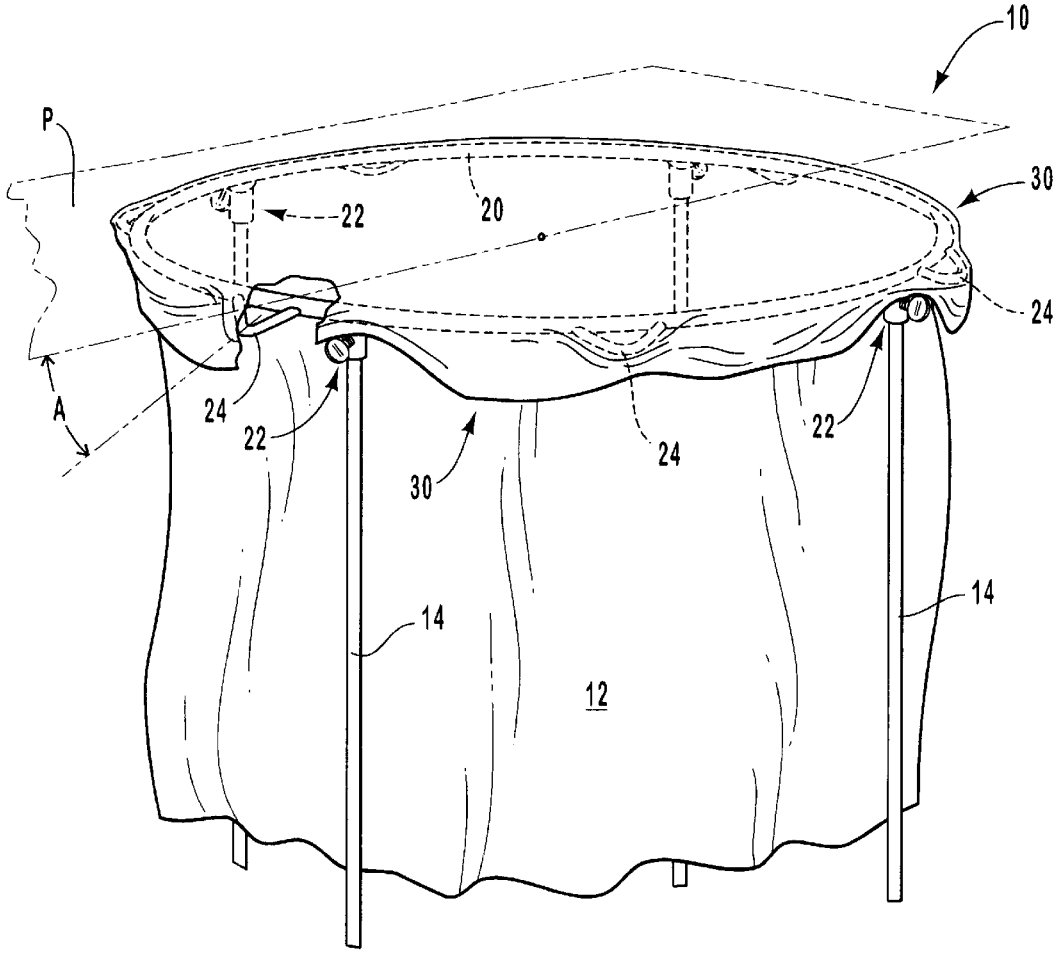
FIG. 2 is an enlarged side perspective view of one embodiment illustrating a retaining mechanism for holding the bag within the device.

As shown in FIG. 2, an enlarged view of the first hoop 20 illustrates how the tabs 24 may be positioned with respect to the first hoop 20. Preferably, the tabs 24 are rigidly attached to the first hoop 20 and extend away from the center of the hoop 20.

In one embodiment, the tabs 24 extend toward the bottom of the device 10 at a specific angle A. The first hoop 20 defines a plane P. The angle A represents the angle at which the tab 24 is directed down away from the plane P, e.g. toward the bottom of the device 10. Angle A may be between about zero and ninety degrees. Preferably, angle A is about thirty degrees.

The tabs 24 provide a simple mechanism for engaging and retaining the mouth 30 of the bag 12. In a preferred embodiment, a plurality of angled tabs 24 extend the "effective" diameter of the first hoop 20 to engage the bag 12. The mouth 30 is folded over the first hoop 20 and each of the tabs 24. The bag 12 may be stretched to fold over the tabs 24. Once the mouth 30 is folded over the tabs 24, the tabs 24 provide a friction stretch-fit type of resistance to the mouth 30 closing. A bias from the stretched mouth 30 and friction provided by the tabs 24 cooperate to retain the mouth 30 around the first hoop 20 while debris, clippings and other material are placed within the bag 12. In addition, the tabs 24 allow the mouth 30 to be easily removed once the bag 12 is filled.

In certain embodiments, the tabs 24 may include a coating of material which increases the coefficient of friction between a plastic bag 12 and the tab 24. For example, the material may be plastic, rubber, or other like substances. In certain embodiments, the coating material temporarily adheres to the plastic bag 12.

Figure 3A:
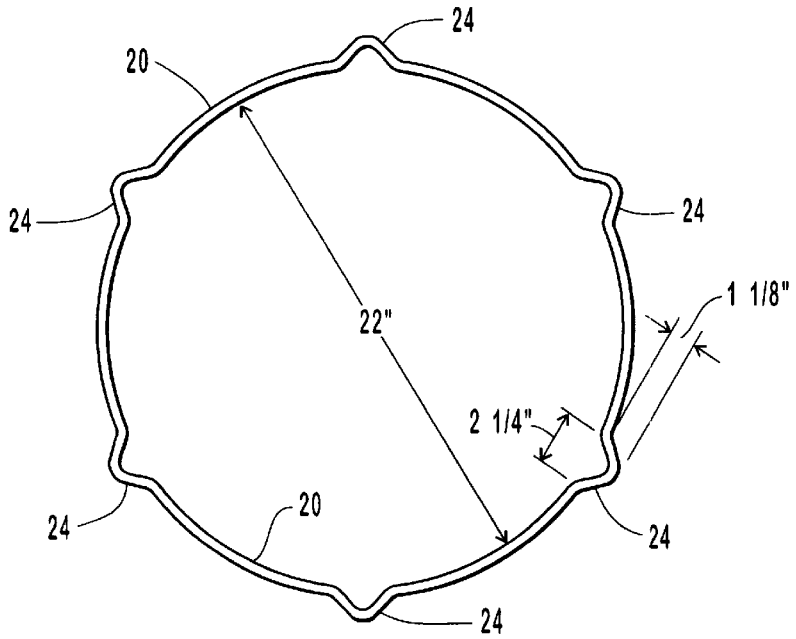
FIG. 3A is a plan view of a one embodiment of a top hoop of the device illustrating tabs formed as part of the top hoop.

FIGS. 1 and 2 illustrate tabs 24 which are attached to the hoop 20. In FIG. 3A, an alternative embodiment, the tabs 24 are formed as part of the first hoop 20. While sizes of components may vary between embodiments, FIG. 3A also illustrates possible dimensions for components such as the width of the tabs 24 and the distance the tabs 24 may extend from the first hoop 20.

Figure 3B:
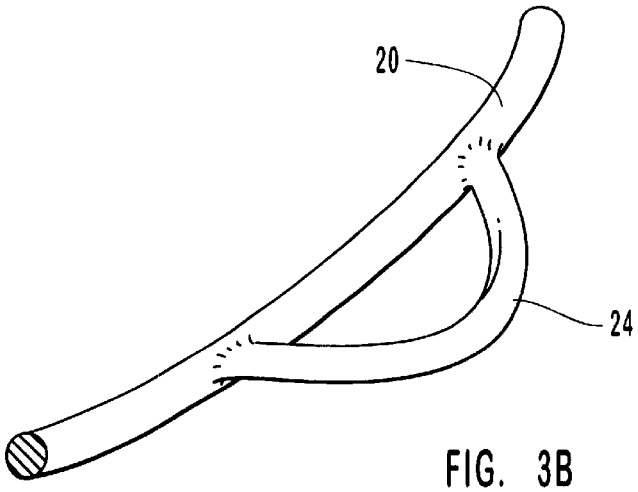
FIG. 3B is a perspective view of a one embodiment of a tab for holding the bag within the device.
Figure 3C:
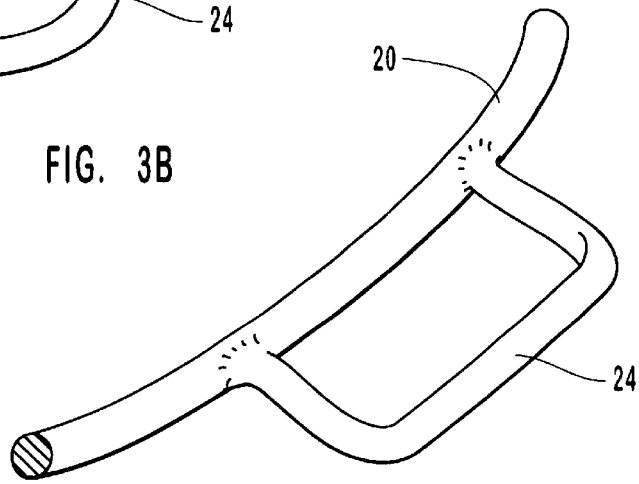
FIG. 3C is a perspective view of another embodiment of a tab for holding the bag within the device.
Figure 3D:
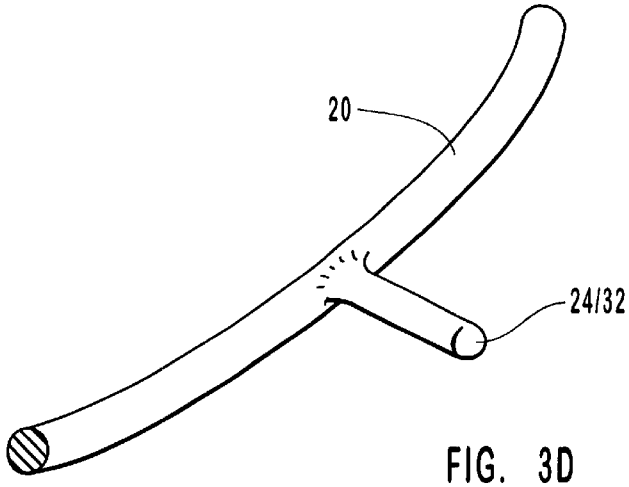
FIG. 3D is a perspective view of yet another embodiment of a tab for holding the bag within the device.

As shown in FIGS. 3B, 3C, and 3D, in alternative embodiments, the tabs 24 may be of a shape other than triangular. For example, in FIG. 3B the tab 24 is a half-circle shape. Alternatively, the tab 24 may be a half-oval shape. In FIG. 3C, the tab 24 is a rectangle shape. In FIG. 3D, the tab 24 is configured as a post 32. In certain configurations, the post 32 may be include a mushroom head (not shown) to prevent puncture of the bag 12. Alternatively, in certain embodiments, a user may desire to puncture the bag 12 using a post 32 as illustrated to ensure the bag 12 is retained while being filled.

Figure 3E:
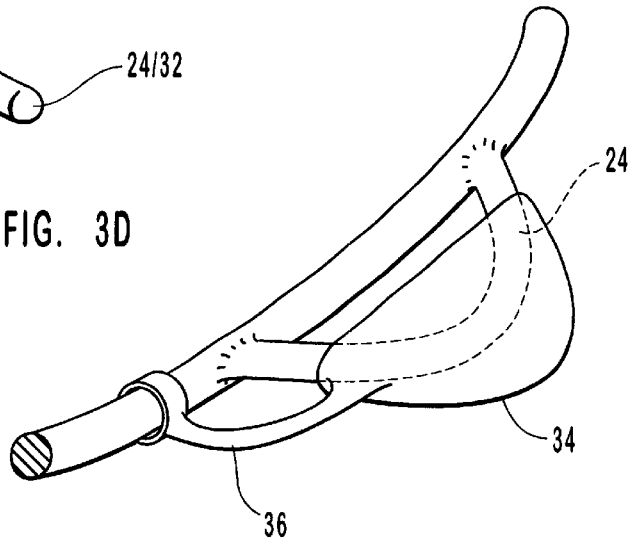
FIG. 3E is a perspective view of an alternative embodiment including an extender to extend a tab of the device.

The present invention is preferably sized to accommodate bags 12 of a number of different sizes, e.g. 33, 39, or 42 gallon sizes. However, a user may desire to use a bag 12 having a mouth 30 with a diameter larger than conventional yard and garden bags. In certain embodiments, as shown in FIG. 3E, the device 10 may include an extender 34 for one or more of the tabs 24.

An extender 34 increases the "effective" diameter of the first hoop 20 and tabs 24. An extender 34 preferably slips over an existing tab 24 to temporarily increasing the length of the tab 24. Preferably, extenders 34 may be of various sizes to increase the length of a tab 24 by as much as one to four inches. By increasing the length of the tabs 24, larger mouth bags 12 may be used with the device 10.

Preferably, the extenders 34 are made from hard plastic. Alternatively, the extenders 34 may be made from rubber, metal, or the like.

For convenience, an extender 34 may be coupled to the first hoop 20 by a tether 36. Preferably, the tether 36 is made of plastic. However, wire, string, leather or the like may also be used. In certain embodiments, multiple extenders 34 of different sizes may be tethered near each tab 24 to allow the device 10 to be used with a wide range of bag sizes.

Figure 4A:
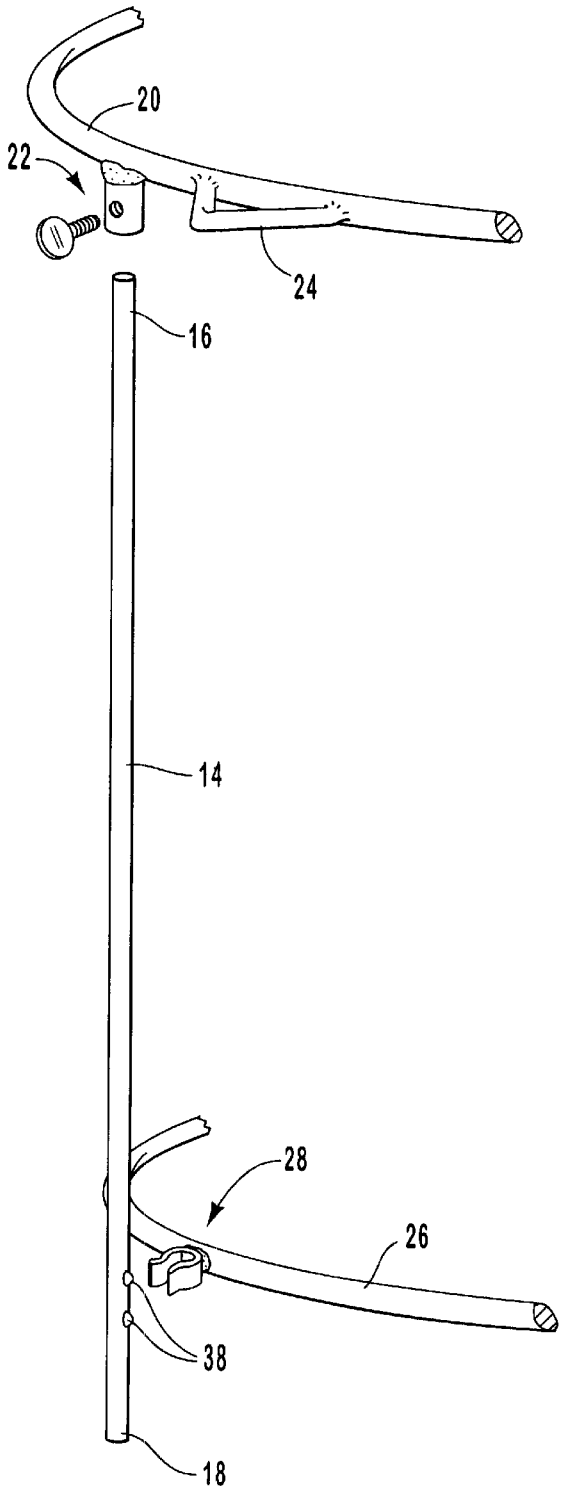
FIG. 4A is a perspective view of one embodiment illustrating disassembled components of the device.
Figure 4B:
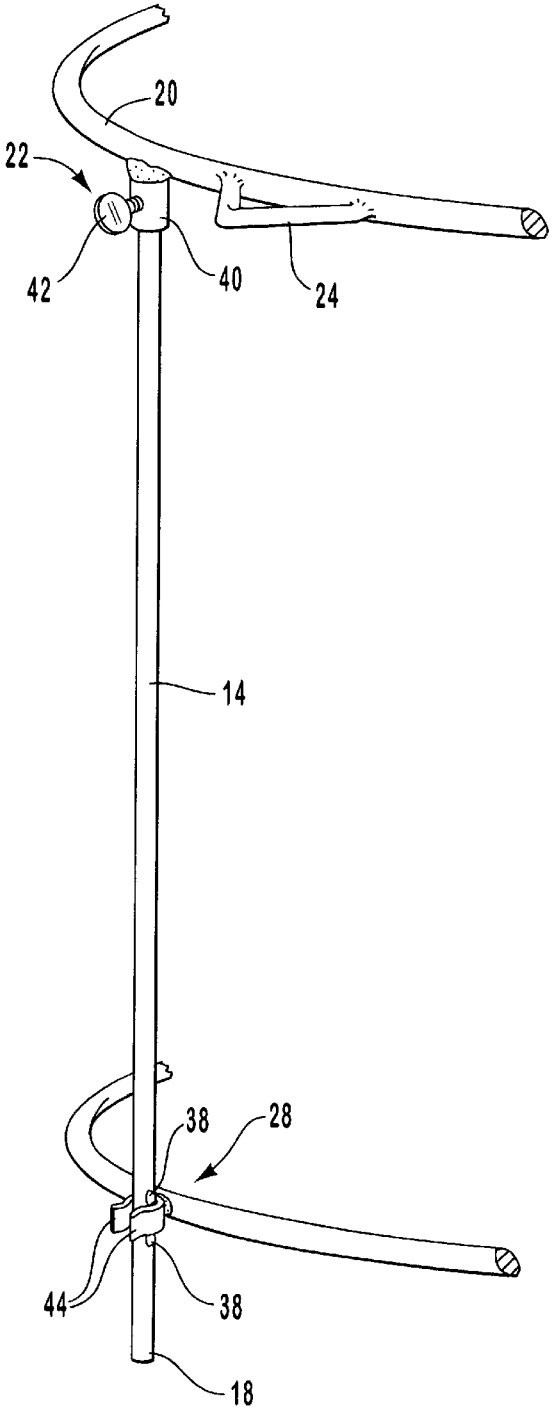
FIG. 4B is a perspective view of one embodiment illustrating assembled components of the device.

As shown in FIG. 1, the device 10 provides a collapsible, temporary frame work for supporting a disposable bag 12. FIGS. 4A and 4B, illustrate how fasteners 22, 28 may be used to quickly assemble and disassemble the device 10.

In FIG. 4A, the top end 16 of a leg 14 is positioned near the thumb screw fastener 22 and perpendicular to the first hoop 20. The second hoop 26 is brought near the bottom end 18 of the leg 14. As illustrated, the second hoop 26 may include a clip retainer fastener 28. The clip retainer fastener 28 may be attached to the second hoop 26 by welding, rivets, screws or the like.

In certain embodiments, a leg 14 may include one or more nubs 38. A single nub 38 may be used to retain a clip retainer fastener 28 from sliding along the leg 14 toward the bottom end 18. In a preferred embodiment, at least two opposing nubs 38 on both sides of the leg 14 are used to retain the clip retainer fastener 28. In one embodiment, nubs 38 are also attached to the leg 14 above the desired connection point. The nubs 38 above the fastener 28 may retain the fastener 28 from sliding toward the top end 16 and guide a user in assembling the device 10. The nubs 38 may be made from welding beads placed on the leg 14.

In FIG. 4B, the leg 14 is illustrated removably connected to the first hoop 20 and the second hoop 26. The top end 16 is inserted in to a socket 40 attached to the first hoop 20. A thumb screw 42 is screwed into to the socket 40 to temporarily bias the leg 14 within the socket 40.

The second hoop 26 is removably connected to the leg 14 by snapping arms 44 of the clip retainer fastener 28 around the leg 14. The clip retainer fastener 28 may hold the leg 14 due to a bias of the arms 44 of the clip retainer fastener 28 against the leg 14. Alternatively, the arms 44 may rest on nubs 38 below the fastener 28. Alternatively, the arms 44 may fit within a notch (not shown) cut into the leg 14. Similarly, two or more additional legs 14 may be connected to the hoops 20, 26 in like manner.

It is contemplated that a variety of fasteners 22, 28 may be used to removably connect the legs 14 to the hoops 20, 26. For example, the top end 16 may include threads allowing the legs 14 to be screwed into threaded sockets 40. In one embodiment, the second hoop 26 and legs 14 may include matching detent notches (not shown). The notches may be matched to connect the second hoop 26 to the legs 14. In another embodiment, Velcro® straps or other kinds of ties may be used. Alternatively, the second hoop 26 and legs 14 may include "J" hooks which open in opposite directions. The "J" hooks may be interlocked to connect the hoop 26 and leg 14. Of course, those of skill in the art will readily recognize a variety of other fasteners 22, 28 which may be used to allow a user to assemble and disassemble the device 10 without tools. These variations on fasteners 22, 28 are also considered within the scope of the present invention.

Referring now to FIGS. 1–4 collectively, the present invention also provides a method of assembling and using the device 10. First, a first hoop 20 having a plurality of tabs 24 extending from the center of the hoop 20 is provided. The first hoop 20 includes at least three thumb screw sockets 40 which are attached perpendicular to a plane defined by the hoop 20. Next, an end 16 of a first leg 14 is secured by a thumb screw 42 within a thumb screw socket 40. Similarly, additional legs 14 may be secured with additional thumb screw sockets 40.

In one embodiment, a second hoop 26 is fastened to each of the legs 14. Preferably, the second hoop 26 is connected near the end opposite where the first hoop 20 is connected. In certain embodiments, the legs 14 and hoops 20, 26 may be connected by fasteners 22, 28 which require no tools.

Once assembled, the unconnected ends 18 of the legs 14 may be depressed into the ground, or turf to stabilize the device 10. Then, a closed plastic bag 12 may be placed within the device 10. The bag 12 is oriented such that the bottom rests on the ground and the mouth 30 reaches the first hoop 20. The mouth 30 of the bag 12 is opened and folded around the first hoop 20. The mouth 30 is also folded around the extending tabs 24 of the hoop 20. Accordingly, the bag 12 is supported by a sturdy support frame. The tabs 24 of the device 10 engage and retain the bag 12 while a user proceeds to fill the bag with clippings, garbage, or other debris.

Once a bag 12 is full, the mouth 30 is easily unfolded from around the first hoop 20 and tabs 24. The mouth 30 may then be secured by a tie. If the bag is full, the device 10 may be lifted up and over the closed bag 12 resting on the ground. The device 10 may then again be pressed into the ground for supporting a second bag 12. If the job is completed, the device 10 may be disassembled by reversing the steps of assembly. The parts of the device 10, one or more hoops 20, 26 and legs 14 may be stored substantially flat within a textile storage bag, or the like. In certain embodiments, to extend the useful life of the device 10, the components, legs 14 and hoops 20, 26 including tabs 24 may be coated with a protective rubber or plastic coating, or painted to prevent rust, make the device more aesthetic, and minimize inadvertent tears of the bag 12.

Figure 5:
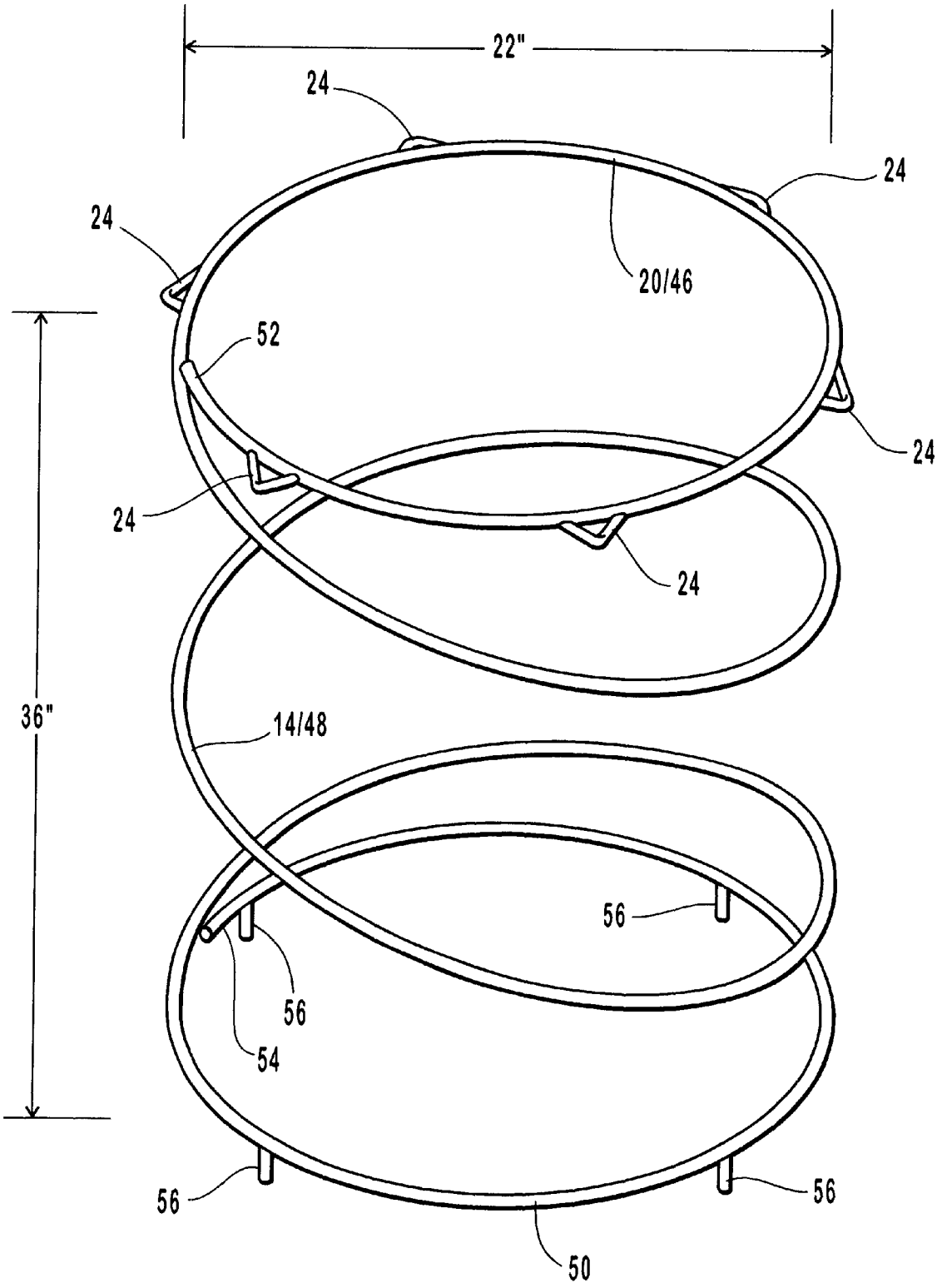
FIG. 5 is a perspective view of an alternative embodiment of the invention.

In an alternative embodiment, shown in FIG. 5, the device 10 may include no moving parts or fasteners 22, 28. In the depicted embodiment, the device 10 includes a hoop portion 20, 46, a helical leg portion 14, 48 and a base portion 50. Note that the hoop portion 20,46 and helical leg portion 14, 48 correspond in function respectively to the hoop 20, and leg 14 discussed above. However, in this embodiment, the form of the hoop portion 20, 46 and helical leg portion 14, 48 may be different.

For example, in one configuration, the hoop portion 20, 46, helical leg portion 14, 48, and base portion 50 may be made from a single shaped rod of resilient material such as metal. One end 52 of the rod may be shaped into a hoop 20 with the remainder of the rod extending away from the hoop 20. The end 52 may be welded to part of the rod to form a circular hoop portion 20, 46. The extending end may be shaped into a coil to form the helical leg portion 14, 48. The remainder of the rod may then be shaped into a circle, half-circle, oval or other polygon to form the base portion 50. The other end 54 may also be welded to the rod.

As mentioned, the hoop portion 20, 46 corresponds to the hoop 20 discussed above. The hoop portion 20, 46 preferably, includes tabs 24 similar to those discussed in relation to FIGS. 1 and 2. The hoop portion 20, 46 is also sized to receive a plastic bag 12 and cooperate with the tabs 24 to secure and retain the mouth 30.

The helical leg portion 14, 48 provides the primary support for the hoop portion 20, 46. Preferably, the helical leg portion 14, 48 is shaped in the form of a coil, or helix. The helical leg portion 14, 48 is also preferably made from a resilient material such that the helical leg portion 14, 48 readily moves from a compressed state to an uncompressed state. The helical leg portion 14, 48 may be a helical spring. Alternatively, in certain embodiments, the helical leg portion 14, 48 may be shaped as a helix but not compress.

When uncompressed the helical leg portion 14, 48, preferably positions the hoop portion 20, 46 at an operable height for supporting a plastic bag 12, e.g. thirty-six inches. Alternatively, one or more coils of the helical leg portion 14, 48 may be compressed and retained by hooks (not shown) or the like to selectively position the hoop portion 20, 46 at different heights.

When fully compressed, the helical leg portion 14, 48 effectively collapses the device 10. The hoop portion 20, 46 is placed in close proximity to the base portion 50. The helical leg portion 14, 48 may be secured in a compressed state using ties, hooks, belts, clasps, and other mechanisms well known in the art. In one embodiment, a textile bag for storing the device 10 may serve to hold the helical leg portion 14, 48 in a compressed state.

The base portion 50 is coupled to the helical leg portion 14, 48 and provides support to orient the device 10 vertically when in use. Of course the base portion 50 may also be a separate piece connected to the helical leg portion 14, 48.

In certain configurations, the base portion 50 includes one or more pins 56. Preferably, the pins 56 are attached to a side of the base portion opposite the side coupled to the helical leg portion 14, 48. The pins 56 may be pressed into the ground or turf to add stability to the device 10 during use. In certain embodiments, the pins 56 may be sharpened.

Preferably, the helical leg portion 14, 48 and base portion 50 are sized and shaped to match the hoop portion 20, 46 such that the bag 12 may hang within the helical leg portion 14, 48 and rest on the ground unimpeded. Sizes and shapes for the hoop portion 20, 46 may correspond to those discussed above in regard to the hoop 20. Alternatively, the helical leg portion 14, 48 and base portion 50 may be of different sizes and/or shapes with respect to the hoop portion 20, 46.

As with embodiments of FIGS. 1–4, the portions 46, 48, 50 may be made from metal, wood, hard plastic, and the like. However, the helical leg portion 48 is preferably made from a resilient material such as metal. For example, ¼ steel rods, discussed above, may be used.

Figure 6A:
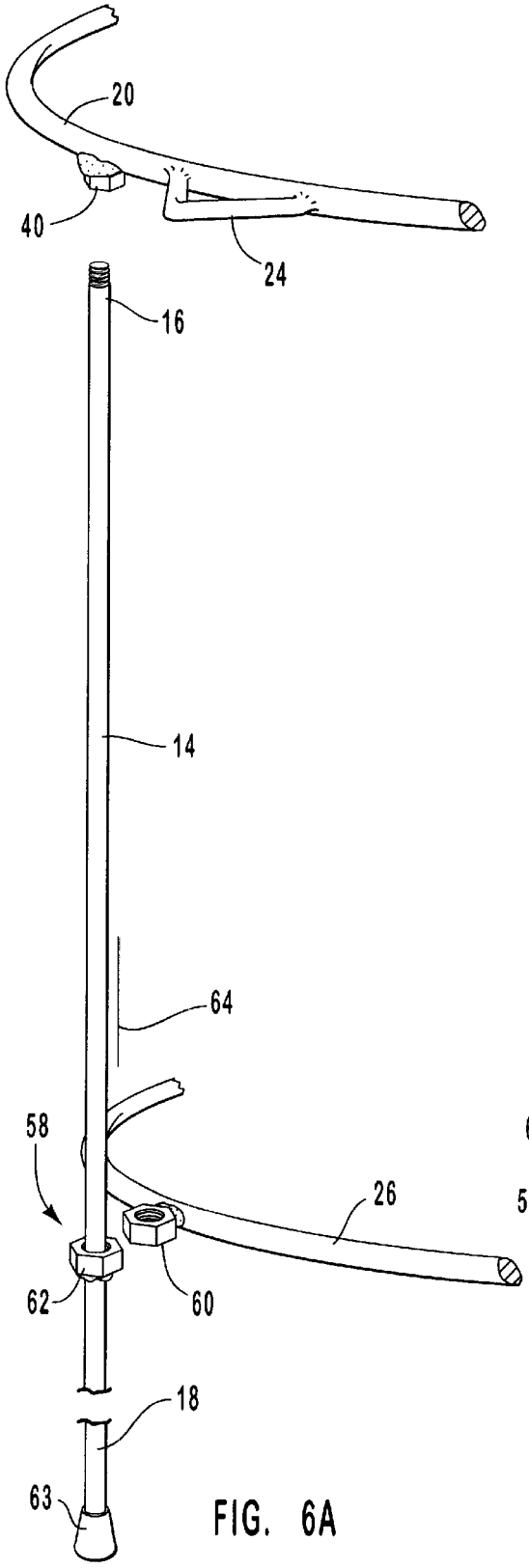
FIG. 6A is a perspective exploded view of an alternative embodiment of the invention.

Referring now to FIG. 6A, the second hoop 26 may not be rigidly fastened to the leg 14. Instead, the second hoop 26 may be slideably connected to the legs 14 through a slideable connection 58. The slideable connection 58 may minimize assembly and disassembly time.

Preferably, a slideable connection 58 includes a collar 60 and a stop 62. The collar 60 may slide along the leg 14 and rest on the stop 62 in an optimal position. Alternatively, the slideable connection 58 may include a collar 60 and screw (not shown) which screws into a screw hole (not shown) in a side of the collar 60 to bias the collar 60 against the leg 14.

In an alternative embodiment, the slideable connection 58 may include a collar 60 and a pin (not shown) in a hole in the side of the collar 60. The leg 14 may include holes (not shown) sized to receive the pin. Thus, the pin may be removed to slide the collar 60 along the leg and re-inserted to secured the collar 60 at a desirable position along the length of the leg 14.

The collar 60 may be sized to receive the leg 14. Preferably, the collar 60 is made of the same material as the second hoop 26. The material may be wood, plastic, metal, or the like. In one embodiment, the collar 60 is rigidly fixed to the second hoop 26 by welding or the like. Of course, the collar 60 may also be formed as part of the second hoop 26. The collar 60 is preferably connected to the second hoop 26 along the hoop's perimeter. A horizontal cross-section of the collar 60 may be circular shaped, polygon shaped, or the like. The collar 60 may be of various widths depending on the embodiment. For example, the collar 60 may comprise a metal ring, sleeve, or the like.

In yet another embodiment, the leg 14 may include threads which match threads on the inside wall of the collar 60. In this manner, the collar 60 may be moved along the length of the leg 14 by screwing the leg 14 in one direction or another.

In certain embodiments, the collar 60 encircles the leg 14 once assembled. Alternatively, the collar 60 may be open on one end. The collar 60 may form a semi-circle, or "U" shape which receives the leg 14 and rests on the stop 62.

Generally, the stop 62 is sized to prevent the collar 60 from sliding along the leg 14 past the position of the stop 62. In one embodiment, the stop 62 and collar 60 are over-sized nuts of equal size. An over-size nut is a nut in which the diameter of the hole from one side of the threads to the other is greater than the diameter of the leg 14. The stop 62 may receive the leg 14 and be rigidly connected to the leg 14 through welding or the like. The stop 62 may encircle the leg 14. Alternatively, the stop 62 may be a semi-circle lip, or "U" shaped lip around a portion of the leg 14.

The stop 62 may be a separate piece fixed to the leg 14. Alternatively, the stop 62 may be formed as part of the leg 14. The stop 62 is preferably positioned closer to the bottom end 18 than the top end 16.

Figure 6B:
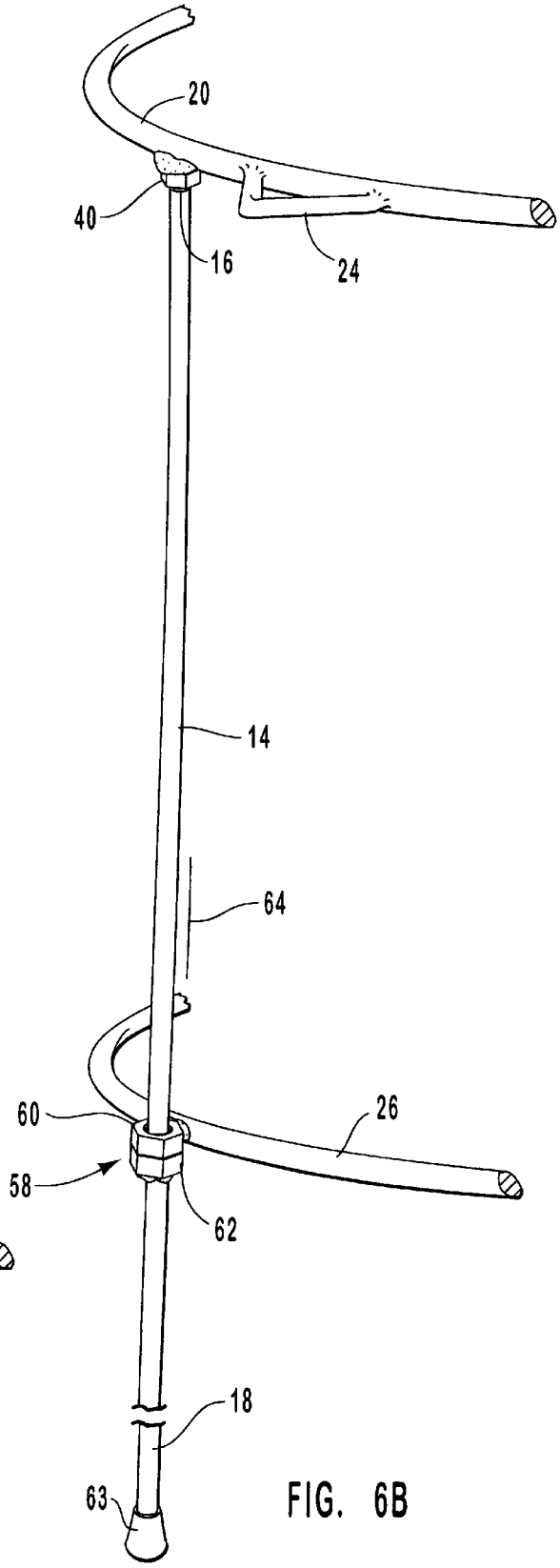
FIG. 6B is a perspective view of an alternative embodiment illustrating assembled components of the device.

In certain embodiments, the collar 60 has an opening which is oriented in a direction which is perpendicular to a plane formed by the second hoop 26. The device 10 may be assembled, as shown in FIG. 6B, by passing a top end 16 of a leg 14 through the collar 60. In addition, collars 60 corresponding to other legs 14 of the device 10 may similarly receive the legs 14. Of course in other embodiments, the bottom end 18 may be passed through the collars 60. Next, the second hoop 26 may be slid along the legs 14 until the collars 60 rest against their corresponding stops 62. Then, each leg 14 may be fastened to the top hoop 20. As illustrated, the top ends 16 may include threaded portions which screw into threaded sockets 40 fixed to the top hoop 20.

In certain embodiments, the diameter of the top hoop 20 and bottom hoop 26 may be substantially the same. Therefore, as each leg 14 is fastened to the top hoop 20 a temporary bend 64 may be introduced along the length of the leg 14 between the top end 16 and the collars 62 of the second hoop 26. The temporary bend 64 may bias the collars 62 to prevent the collars 62 from sliding away from the stops 62, toward the top end 16 of the legs 14.

Once each leg 14 is fastened to the top hoop 20 the device 10 may be ready for use. To disassemble the device 10, the steps of assembly may simply be reversed.

In certain embodiments, at least one leg 14 may include a cap 63 over the bottom end 18. Preferably, a cap 63 is used with each leg 14. The cap 63 is preferably made from plastic or rubber and is sized to fit snuggly on the end 18. The cap 63 protects a surface on which the device 10 may stand. The cap 63 allows the device 10 to be used on surfaces which may normally be damaged by the exposed end 18 of the leg 14, particularly with embodiments in which the end 18 of the leg 14 is sharpened to a point. Thus, with one or more caps 63 the device 10 may be used indoors on carpet or linoleum, or the like.

Based on the foregoing, the present invention offers a number of advantages not available in conventional approaches. The present invention may be used with plastic bags of various sizes. In addition, the present invention includes a bag retention mechanism which is simple, can accommodate different size bags, uses no moving parts, and effectively holds the mouth of the bag open. The bag retention mechanism allows a user to easily secure a bag to the device even in windy conditions. Furthermore, the present invention allows a sole user to easily add or remove material from the bag and easily change a bag supported by the device without lifting the filled bag. The present invention may be quickly assembled (certain embodiments require no assembly) and collapsed without tools. The collapsed components of the present invention may be stored in a relatively flat thin space. The present invention may be assembled with the second hoop in the optimal position very quickly and easily. And finally, the present invention is light-weight, sturdy, durable, simple and inexpensive to fabricate.

While specific embodiments and applications of the present invention have been illustrated and described, it is to be understood that the invention is not limited to the precise configuration and components disclosed herein. Various modifications, changes, and variations apparent to those skilled in the art may be made in the arrangement, operation, and details of the methods and systems of the present invention disclosed herein without departing from the spirit and scope of the invention.

What is claimed is:

1. A device for supporting a plastic bag, the device comprising:

a plurality of legs, each leg having a top end and a bottom end;

a first hoop connected to the top ends of the legs, the first hoop having at least one tab that extends from the first hoop;

a second hoop slideably connected to the legs between the top and bottom ends;

wherein the at least one tab is configured to engage and retain a plastic bag;

a collar connected at the perimeter of the second hoop, the collar being configured to receive a leg and a collar opening of the collar being oriented perpendicular to a plane defined by the second hoop.

2. The device of claim 1, wherein the collar includes a screw and corresponding screw hole for biasing the collar against the leg.

3. The device of claim 1, wherein the collar is circular shaped.

4. The device of claim 1, wherein the collar is "U" shaped.

5. The device of claim 1, wherein the collar is polygon shaped.

6. The device of claim 1, wherein at least one leg comprises a stop between the top and bottom ends, the stop being configured to prevent the collar from sliding along the leg past the stop.

7. The device of claim 6, wherein the stop is positioned closer to the bottom end than the top end.

8. The device of claim 7, wherein the top and bottom hoops have substantially the same diameter and wherein the bottom hoop is positioned such that the collar contacts the stop and bends the leg to introduce a temporary bend in the leg, the bend preventing the collar from freely sliding along the leg away from the stop.

9. The device of claim 6, wherein the stop is rigidly connected to the leg.

10. The device of claim 6, wherein at least one leg includes a cap over the bottom end.

11. A method for providing a support frame for a plastic disposable bag, the method comprising:

providing a first hoop having a plurality of tabs extending from a center axis of the first hoop, the first hoop further having at least three fasteners;

providing a second hoop having at least three collars fixed to the perimeter of the second hoop, the openings of the collars being oriented perpendicular to a plane formed by the second hoop;

passing an end of at least three legs through each of the collars of the second hoop, the collars being configured to slideably engage the legs; and securing the top end of at least three legs with the fasteners to the first hoop.

12. The method of claim 11, further comprising:

sliding the second hoop along each of the legs until the collars rest against corresponding stops.

13. The method of claim 12, wherein securing the top end of each leg further comprises creating a bend in each of the legs and wherein the bend prevents the second hoop from freely moving in a direction opposite the stops.

14. The method of claim 11, wherein the collar openings are sized to receive the, legs and the stops are sized to prevent sliding of a collar along a leg.

15. The method of claim wherein the collar comprises an over-sized nut welded to the second hoop.

16. The method of claim 11, wherein the stop comprises an over-sized nut welded to a leg.

17. The method of claim 11, wherein the collar comprises a metal ring.

18. The method of claim 11, wherein the collar comprises a metal sleeve.

19. The method of claim 11, wherein the collar has a circular cross-section.

20. The method of claim 11, wherein the collar has a polygon crosssection.

* * * * *

UNITED STATES PATENT AND TRADEMARK OFFICE

CERTIFICATE OF CORRECTION

PATENT NO. : 6,520,457 B1 
DATED : February 18, 2003
INVENTOR(S) : Yardley et al.

It is certified that error appears in the above-identified patent and that said Letters Patent is hereby corrected as shown below:

Title page,
Item [57], ABSTRACT,
Line 10, "stops a bend" should read -- stops, a bend --.

Column 1,
Line 38, "cans particularly" should read -- cans, particularly --.

Column 2,
Lines 6 and 8, "of a one" should read -- of one --.

Column 3,
Line 55, "temporary. tasks" should read -- temporary tasks --.

Column 5,
Line 34, "device 10" should read -- device 10, --.

Column 6,
Line 31, "may be include" should read -- may include --.
Line 45, "to temporarily increasing" should read -- to temporarily increase --.
Line 61, "4B, illustrate" should read -- 4B illustrate --.

Column 7,
Line 18, "into to the" should read -- into the --.

Column 8,
Line 42, "preferably, includes" should read -- preferably includes --.
Line 55, "uncompressed the" should read -- uncompressed, the --.
Line 55, "48," should read -- 48 --.

Column 10,
Line 33, "collars 62" should read -- collars 60 --.
Lines 34-35, "collars 62" should read -- collars 60 --.
Line 35, "collars 62" should read -- collars 60 --.
Line 37, "hoop 20 the" should read -- hoop 20, the --.
Line 49, "63 the" should read -- 63, the --.
Line 66, "flat thin" should read -- flat, thin --.

UNITED STATES PATENT AND TRADEMARK OFFICE

CERTIFICATE OF CORRECTION

PATENT NO. : 6,520,457 B1 
DATED : February 18, 2003
INVENTOR(S) : Yardley et al.

It is certified that error appears in the above-identified patent and that said Letters Patent is hereby corrected as shown below:

Column 12,
Line 31, "the, legs" should read -- the legs --.
Line 33, "claim wherein" should read -- claim 11, wherein --.
Line 44, "crosssection" should read -- cross-section --.

Signed and Sealed this

Fifteenth Day of April, 2003

JAMES E. ROGAN
*Director of the United States Patent and Trademark Office*